United States Patent [19]

Tetsuro

[11] 4,387,538

[45] Jun. 14, 1983

[54] GRINDING MACHINE ASSEMBLY

[75] Inventor: Oshimi Tetsuro, Nagoya, Japan

[73] Assignee: Noritake, Co., Limited, Nagoya, Japan

[21] Appl. No.: 308,856

[22] Filed: Oct. 5, 1981

[51] Int. Cl.[3] ..... B24B 7/02

[52] U.S. Cl. ..... 51/35; 51/34 D; 51/34 R

[58] Field of Search ..... 51/34 R, 34 D, 34 E, 51/34 F, 34 G, 35

[56] References Cited

U.S. PATENT DOCUMENTS

| | | | |
|---|---|---|---|
| 3,708,920 | 1/1973 | Kaszuba | 51/35 X |
| 3,878,654 | 4/1975 | Wendt et al. | 51/34 D |
| 4,062,151 | 12/1977 | Hjalmarson | 51/35 |
| 4,255,404 | 3/1981 | Dougherty | 51/35 |

*Primary Examiner*—James G. Smith
*Assistant Examiner*—Willmon Fridie, Jr.
*Attorney, Agent, or Firm*—Wenderoth, Lind & Ponack

[57] ABSTRACT

A grinding machine assembly includes a tiltable frame mounted in a machine frame movable back and forth on a machine base by a hydraulic cylinder assembly. A balancing pneumatic cylinder is suspended from an upper portion of the machine frame and supporting the tiltable frame for tilting movement. A frame is mounted on the tiltable frame for lateral slidable and angular movements and a rocking cylinder connected between a side bar of the tiltable frame and the frame. A lateral positional correction cylinder is connected between a rotative bar in the frame and a support plate. A motor for driving a grinding wheel is mounted rearwardly on the frame and is operatively coupled through a bevel-gear mechanism to a grinding head including the grinding wheel and angularly movable in the horizontal plane. A hydraulic cylinder is pivotally connected to the machine frame at its front, upper portion and having a piston rod pivotally connected at its distal end to the grinding head.

3 Claims, 15 Drawing Figures

GRINDING MACHINE ASSEMBLY

BACKGROUND OF THE INVENTION

1.Field of the Invention

The present invention relates to a grinding machine assembly including a pneumatic cylinder for balancing a tiltable frame supporting a grinding head and a hydraulic cylinder for applying a grinding pressure to a grinding wheel.

2. Prior Art

Grinding wheels have conventionally been forced against workpiece surfaces with a grinding pressure from hydraulic or pneumatic cylinders. The pneumatic cylinders have high followability, but find difficulty in rapidly controlling the grinding pressure with precision. Conversely, the hydraulic cylinders provide precision control of the grinding pressure and a high degree of responsiveness, but fail to give high followability. Such lack of followability is a serious problem especially with large-size grinding machining having heavy grinding heads.

SUMMARY OF THE INVENTION

According to the present invention, a tiltable frame is pivotally mounted at its rear portion in a machine frame movable back and forth on a machine base and is suspended by a pneumatic cylinder mounted on the machine frame. A relatively heavy motor for driving a grinding wheel is disposed in a rearward position on the tiltable frame so as to assist the pneumatic cylinder in having increased followability when the grinding operation is performed on a curved surface of a workpiece. The driving motor and the shaft for the grinding wheel are operatively coupled by a bevel-gear mechanism such that the grinding head can be angularly moved by a predetermined angle. There is provided a mechanism for correcting or compensating for lateral and longitudinal displacement of the grinding wheel away from the workpiece surface to be grounded when the grinding head is angularly moved.

DETAILED DESCRIPTION

Figure 1:
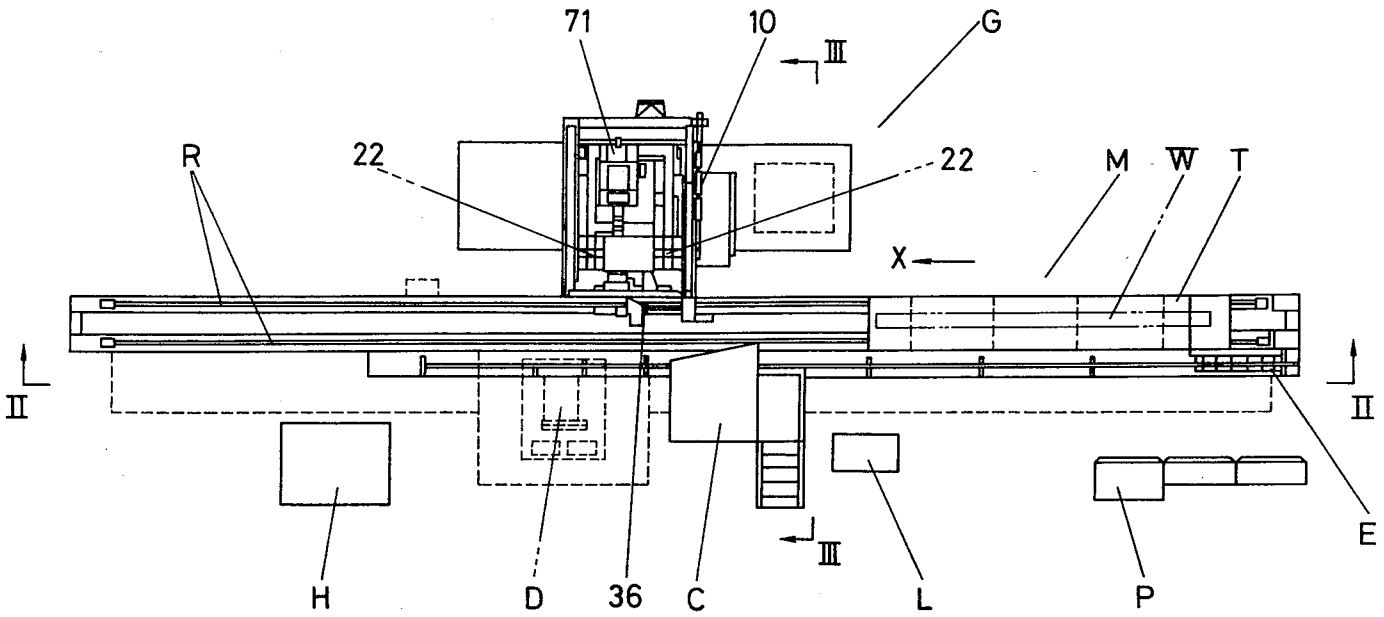
FIG. 1 is a plan view of a grinding machine.
Figure 2:
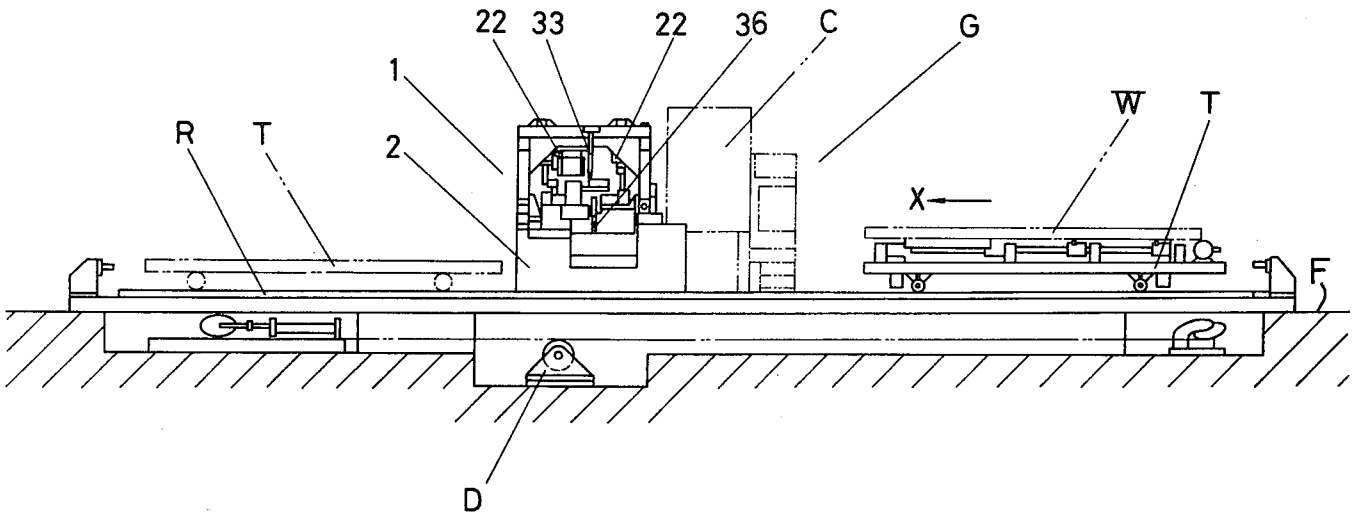
FIG. 2 is a front elevational view of the grinding machine as viewed in the direction of the arrows II—II of FIG. 1.
Figure 3:
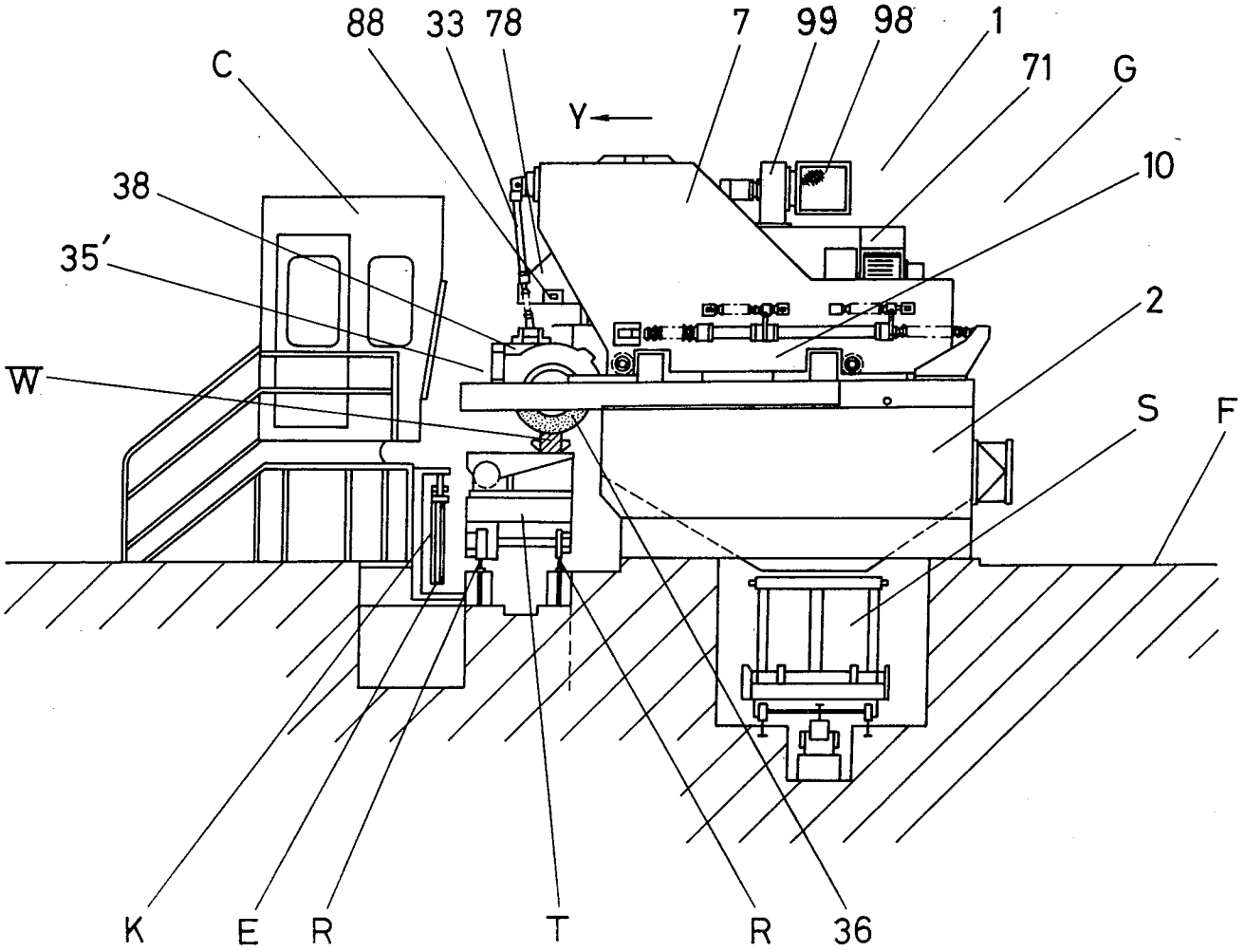
FIG. 3 is an enlarged side elevational view of the grinding machine as viewed in the direction of the arrows III—III of FIG. 1.

As shown in FIGS. 1 through 3, a grinding machine G comprises a workpiece transfer apparatus M including a table T movable reciprocably along a pair of rails R, R for carrying thereon a workpiece W and means D for driving the table T, a grinding machine assembly 1 having a primary dust collector S and located on one side of the workpiece transfer apparatus M substantially centrally thereof, a control chamber C located on the other side of the apparatus M in substantially confronting relation to the grinding machine assembly 1 across the rails R, R, a hydraulic-pressure generator H, an electrical control panel P, a lubricator L, and a side channel K running along the rails R, R and receiving a power-supply cable E.

In FIGS. 4 through 8, the grinding machine assembly 1 comprises a machine base 2 mounted on a floor F and supporting thereon a pair of beams 3, 3' on which a pair of rails 4, 4 are mounted, and a machine frame 6 having rolls 5, 5 in rolling engagement with the rails 4, 4, the machine frame 6 including a pair of side plates 7, 7 supporting on their lower ends side rolls 8, 8 held in forced rolling engagement with the side faces of the rails 4, 4. A hydraulic cylinder assembly 10 includes a normal cylinder 11 having a piston rod 12 pivotally coupled at its distal end to a bracket 9 mounted on a rear end portion of one of the beams 3, and a correction cylinder 13 disposed in back-to-back relation to the normal cylinder 11 and having a piston rod 14 pivotally coupled at its distal end to a bracket 15 mounted on a front, lower portion of a side face of one of the side plates 7. A guide cylinder 16 secured to a rear end of the normal cylinder 11 is slidably fitted over a guide rod 19 mounted on the side plate 7 in parallel relation to the hydraulic cylinder assembly 10, and likewise a guide cylinder 18 secured to a junction 17 between the normal and correction cylinders 11, 13 is slidably fitted over a guide rod 20 mounted on the side plate 7 in parallel relation to the hydraulic cylinder assembly 10.

The machine frame 6 includes a pair of brackets 21, 21 on its upper portion that extend toward each other. A pair of balancing pneumatic cylinders 22, 22 pivotally mounted on the brackets 21, 21, respectively, include a pair of respective piston rods 23, 23 pivotally coupled via pins 28, 28 to a pair of respective brackets 27, 27 fixed to a pair of side bars 26, 26, respectively, of a tiltable frame 25 that is pivotally connected by a shaft 24 to the machine frame 6 at its rear, lower portion. Thus the tiltable frame 25 is suspended within the machine frame 6 by the balancing pneumatic cylinders 22, 22. The machine frame 6 further includes a crossbeam 30 extending between a pair of nose portions 29, 29 of the sides plates 7, 7 of the machine frame 6. A pair of bearings 31, 31 is mounted centrally on the crossbeam 30 and supports therebetween a shaft 32 to which a vertical hydraulic cylinder 33 is pivotally attached for back-and-forth angular movement about the shaft 32. The hydraulic cylinder 33 has a piston rod 34 pivotally coupled at its distal end to a shaft 39 supported between a pair of bearings 38, 38 mounted on a housing 37 for a grinding wheel 36 of a grinding head 35' in a grinding unit 35. Thus the grinding wheel 36 can be downwardly forced by the hydraulic cylinder 33.

Figure 10:
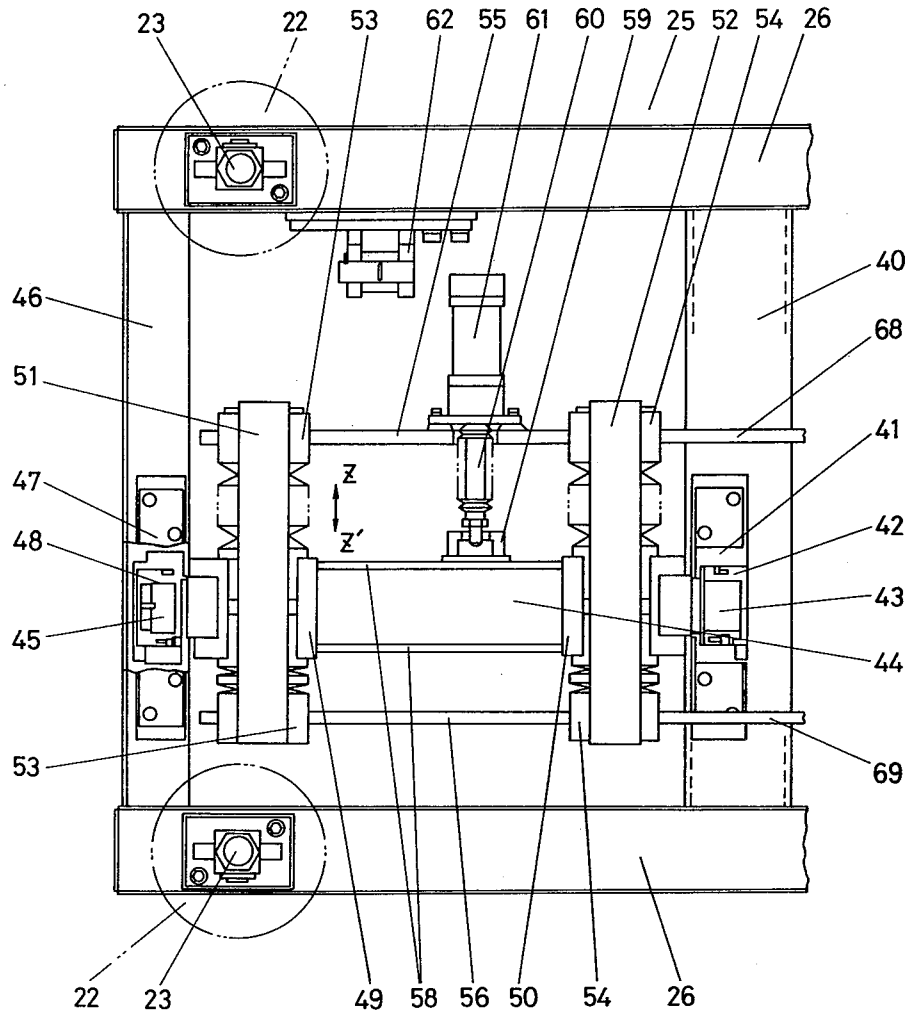
FIG. 10 is an enlarged plan view of the tiltable frame and a tilting mechanism therefor.
Figure 11:
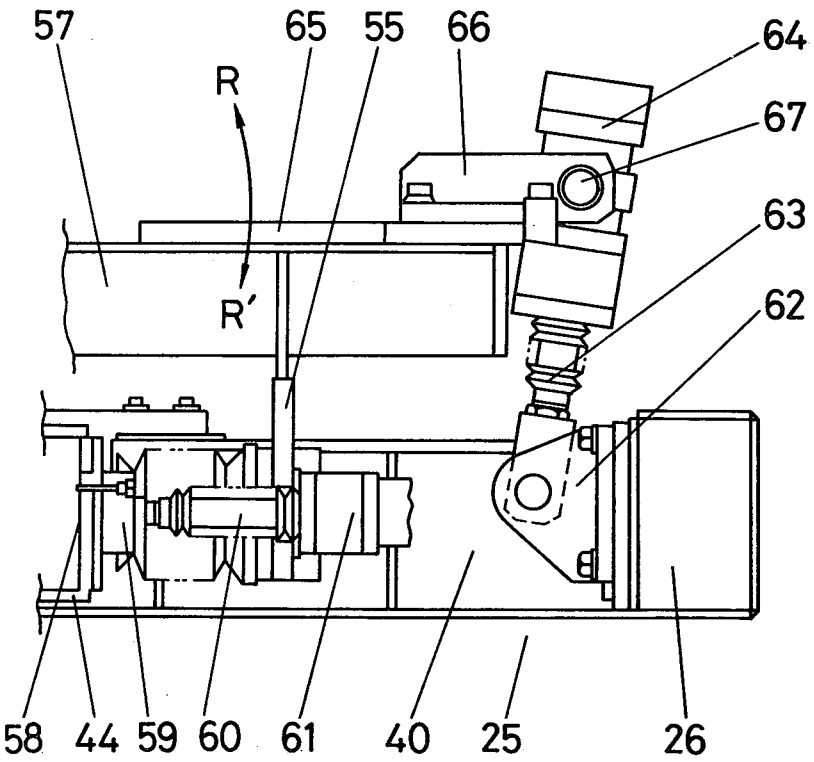
FIG. 11 is a fragmentary side elevational view of the tilting mechanism.

In FIGS. 8 through 11, the tiltable frame 25 includes a pair of side bars 26, 26 between which a crossbeam 40 extends at their substantially central position, the crossbeam 40 supporting thereon a bearing 41 in which there is fitted another bearing 42 receiving a rear end (a right-hand) end as viewed in FIG. 10) of a shaft 43 on a rotative bar 44. The rotative bar 44 has a front shaft 45 fitted in a bearing 48 received in another bearing 47 mounted on a front crossbeam 46 extending between the side bars 26, 26 at their front end (a left-hand end as viewed in FIG. 10). The rotative bar 44 supports thereon a pair of front and rear sliding bushings 49, 50 that are parallel to each other through which a pair of slide bars 51, 52 are respectively disposed for reciprocating sliding movements in the directions of the arrowheads Z, Z'. The slide bar 51 supports at its ends a pair of rings 53, 53, and the slide bar 52 supports at its ends a pair of rings 54, 54. A pair of supports plates 55, 56 which extend substantially horizontal are fixed to and disposed between one pair of the rings 53, 54 and between the other pair of the rings 53, 54, respectively. A frame 57 is secured to the support plates 55, 56. A bearing 59 is mounted on one of a pair of side plates 58 of the rotative bar 44. The distal end of a piston rod 60 of a hydraulic cylinder 61 is pivotally coupled to the bearing 59, the hydraulic cylinder 61 being mounted on the support plate 55 for lateral positional correction for the tiltable frame 25. As best illustrated in FIG. 11, one of the side bars 26 of the tiltable frame 25 supports thereon a bracket 62 to which the distal end of a piston rod 63 of a rocking cylinder 64 is pivotally connected, the cylinder 64 is supported for angular movement on a pin 67 attached to a support arm 66 that is mounted via a reinforcing plate 65 on an end portion of the frame 57.

Figure 12:
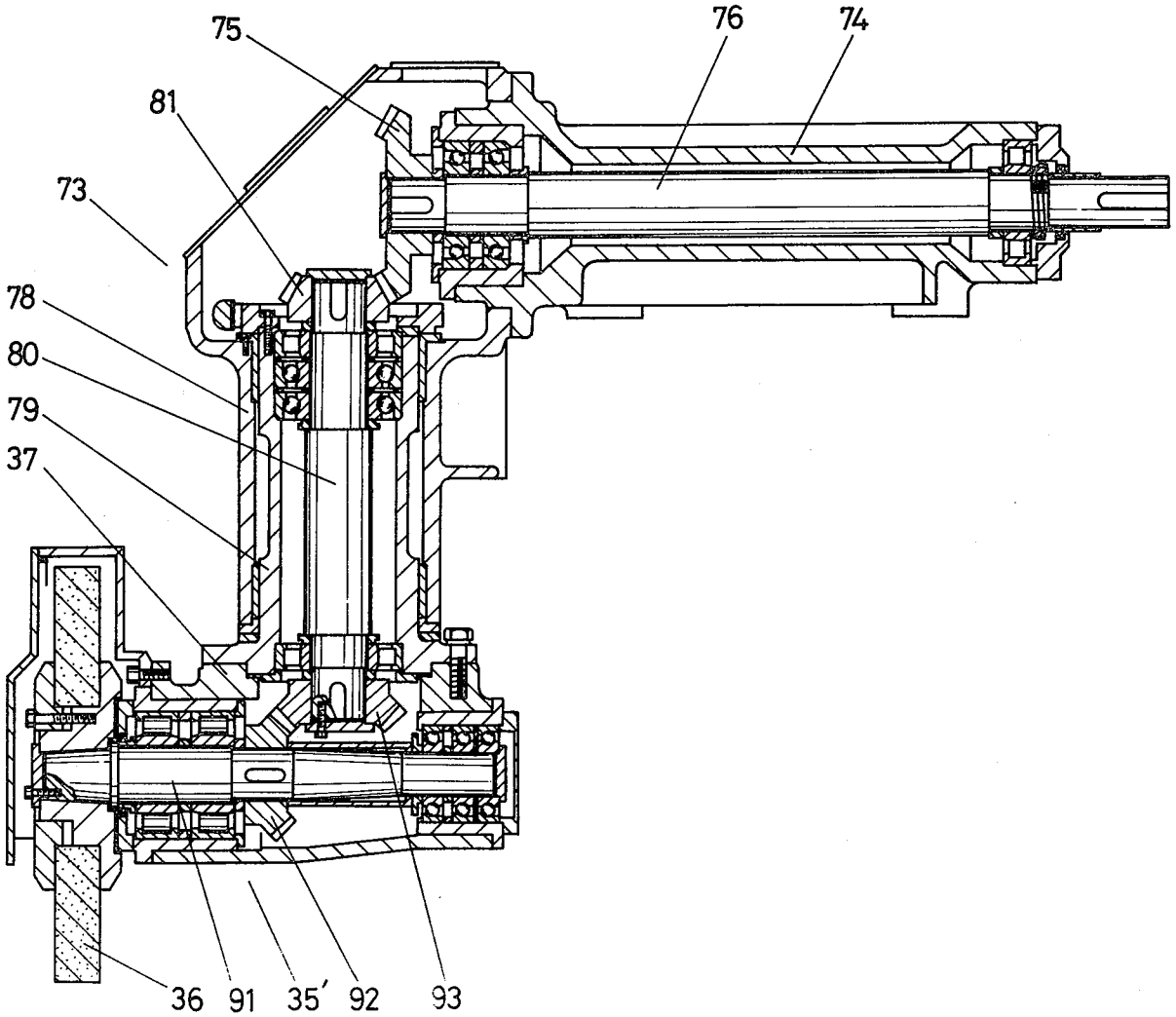
FIG. 12 is an enlarged vertical cross-sectional view of a train of bevel-gears for driving a grinding wheel.
Figure 13:
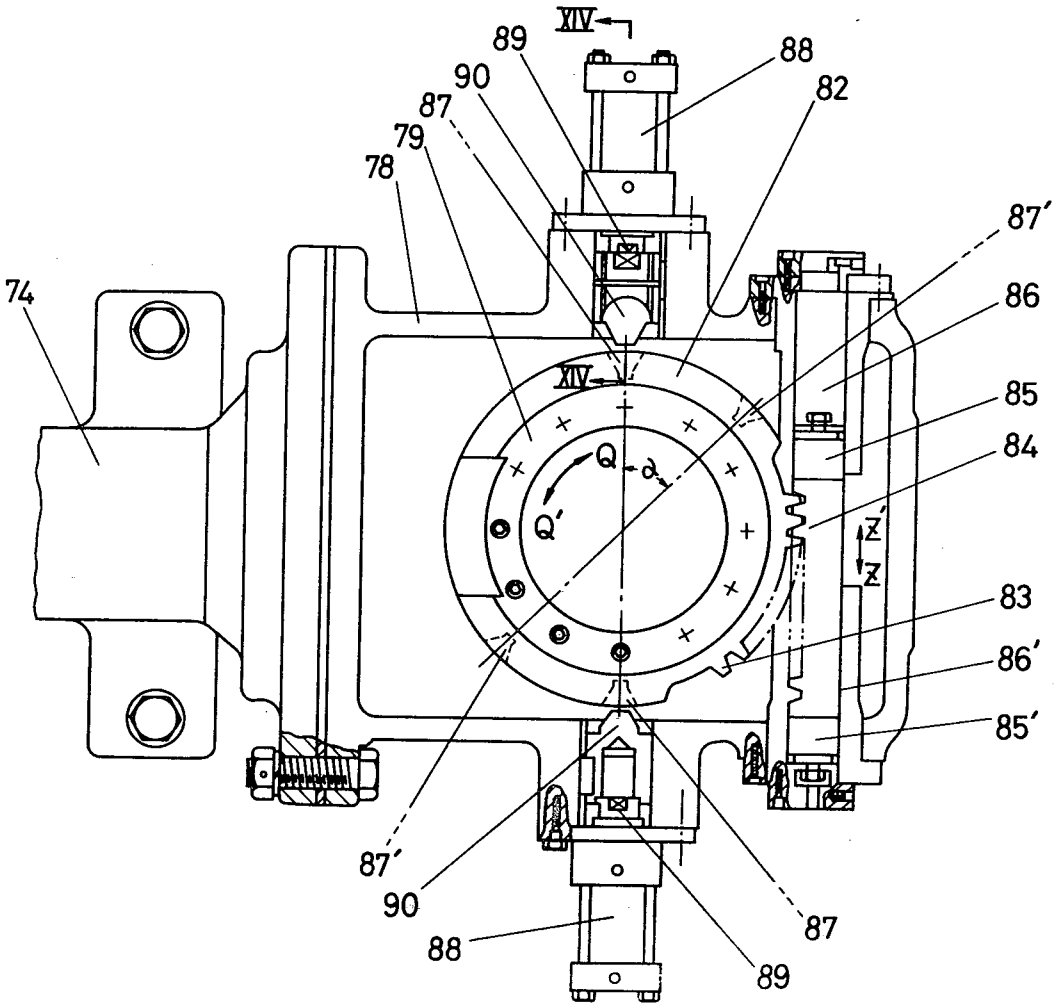
FIG. 13 is an enlarged plan view of an angular displacement mechanism for the grinding wheel.
Figure 14:
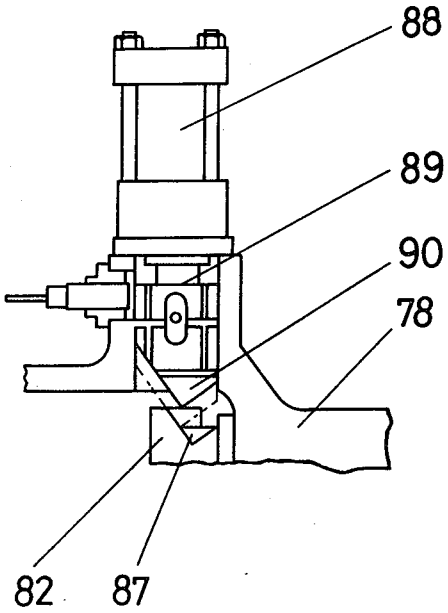
FIG. 14 is a cross-sectional view taken along line XIV—XIV of FIG. 13.

The support plates 55, 56 have a pair of respective rearward extensions 68, 69 on which there is mounted a mount board 70 supporting thereon a motor 71 for driving the grinding wheel 36. The motor 71 includes a motor shaft 72 connected by a coupling 77 to a rotative shaft 76 housed horizontally in a casing 74 and extending from a bevel-gear 75 of a bevel-gear mechanism 73 fixed forwardly of the tiltable frame 25 (see FIGS. 8 and 12). In FIG. 12, the bevel-gear mechanism 73 also includes a bevel-gear 81 meshing with the bevel-gear 75 and mounted on an upper end of a vertical rotative shaft 80 housed in a rotative sleeve 79 rotatably mounted in a casing 78 extending downwardly and secured to the distal end of the casing 74 in substantially perpendicular relation therewith. As shown in FIGS. 13 and 14, an annular member 82 is fixedly mounted around an upper end of the rotative sleeve 79 and has a segmental gear 83 held in mesh with a rack 84 having on its ends a pair of respective hydraulic cylinders 86, 86' mounted on the casing 78 in confronting relation to each other. The annular member 82 also has a first pair of diametrically opposite slots 87, 87 and a second pair of diametrically opposite slots 87', 87', the slots having tapered surfaces converging radially inwardly. The first and second pairs of slots 87, 87 and 87', 87' are angularly spaced from each other by an angle of $\alpha$. A pair of hydraulic cylinders 88, 88 are mounted on the casing 78 in confronting relation to each other diametrically across the annular member 82, and have a pair of respective piston rods 89, 89 to the distal ends of which there are attached a pair of corresponding locking projections 90, 90 having tapered surfaces complemental in shape with those of the slots 87, 87.

As illustrated in FIG. 12, the housing 37 for the grinding wheel 36 is mounted on a lower end of the rotative sleeve 79 and houses therein a rotatable shaft 91 on which is mounted a bevel-gear 92 held in mesh with a bevel-gear 93 secured to a lower end of the shaft 80. The grinding head 35' is thus constructed.

In the drawings, designated at 94 is a drain pump for lubricating oil, 95 a motor, 96 a drain pump mount disposed on the tiltable frame 25, 97 a motor for a cooler fan 99 for the motor 71, 98 an air filter, 100, 101 limit switches for indicating the completion of lateral positional correction, and 102 a dog for actuating the limit switches.

Figure 15:
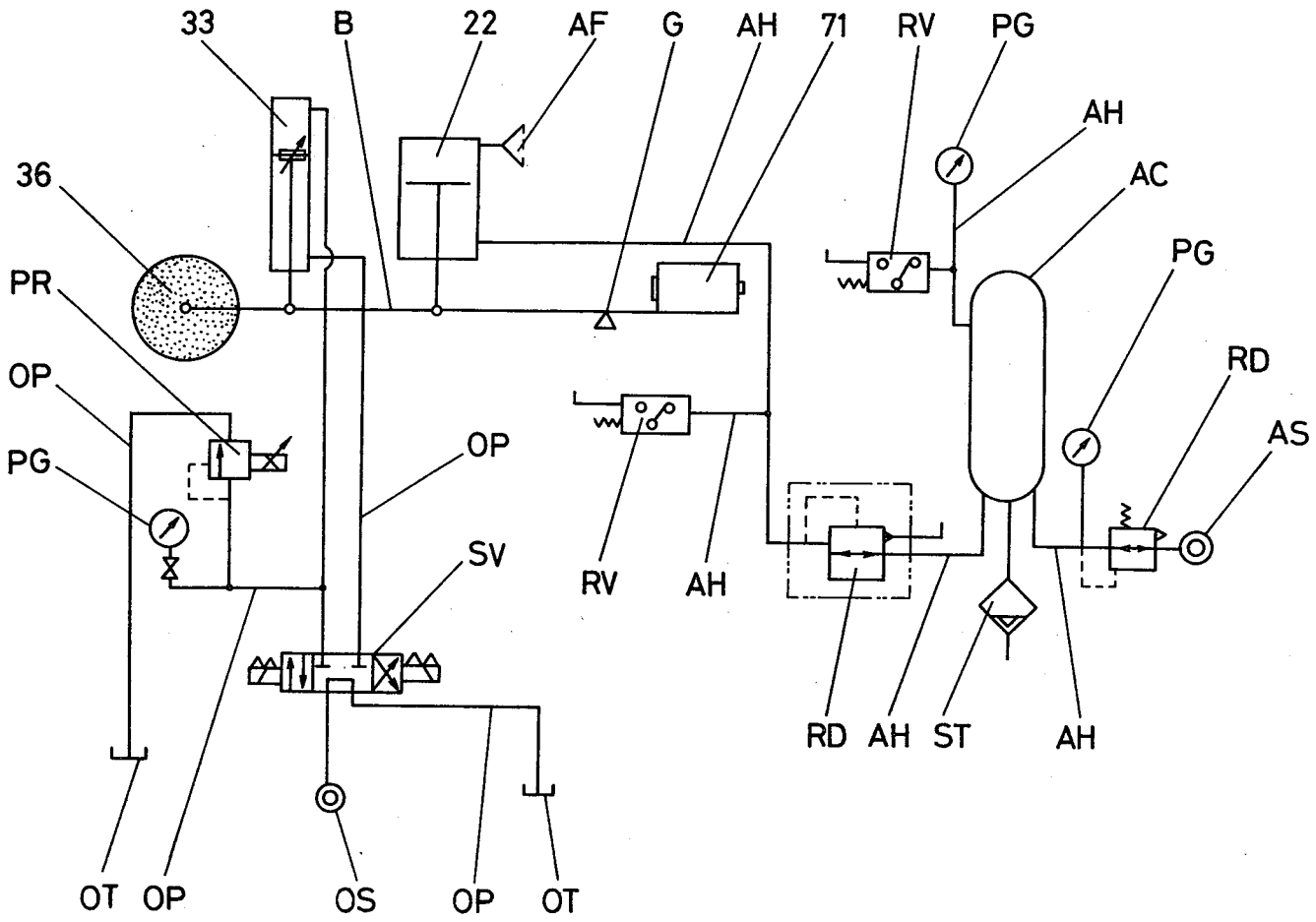
FIG. 15 is a hydraulic and pneumatic circuit diagram for the control of the grinding machine assembly.

FIG. 15 illustrates a hydraulic and pneumatic circuit diagram for controlling the grinding machine assembly of the present invention. Designated at PG is a pressure gage, PR a pressure regulating valve, RV a relief valve, AC an accumulator, DV a direction valve, RD a reducing valve, AH an air hose, OP an oil pipe, OS an oil supply, AS an air supply, OT an oil tank, ST a strainer with drainage, AF an air filter, B an operative structure connecting the grinding wheel 36, hydraulic cylinder 33 and pneumatic cylinder 22, and G a fulcrum for such an operative structure.

OPERATION

In FIGS. 1 through 3, a workpiece W with its surface having flaws upwardly, is first placed on the table T, and the driving means D is then actuated to cause the table T to travel along the rails R in the direction of the arrow X. When the surface flaws on the workpiece W are located just below the grinding wheel 36 of the assembly 1, the table T is stopped and the grinding machine assembly 1 is actuated for grinding the workpiece W.

The grinding operation of the grinding machine assembly 1 is as follows: In FIGS. 4 through 7, the normal cylinder 11 is first actuated to extend its piston rod 12, whereupon the machine frame 6 moves in the direction of the arrow Y as the rolls 5, 5 roll on the rails 4, 4 with the machine frame 6 being stabilized by the side rolls 8, 8. The normal cylinder 11 is inactivated when the center of the grinding wheel 36 is aligned vertically with the surface flaw on the workpiece W.

Figure 8:
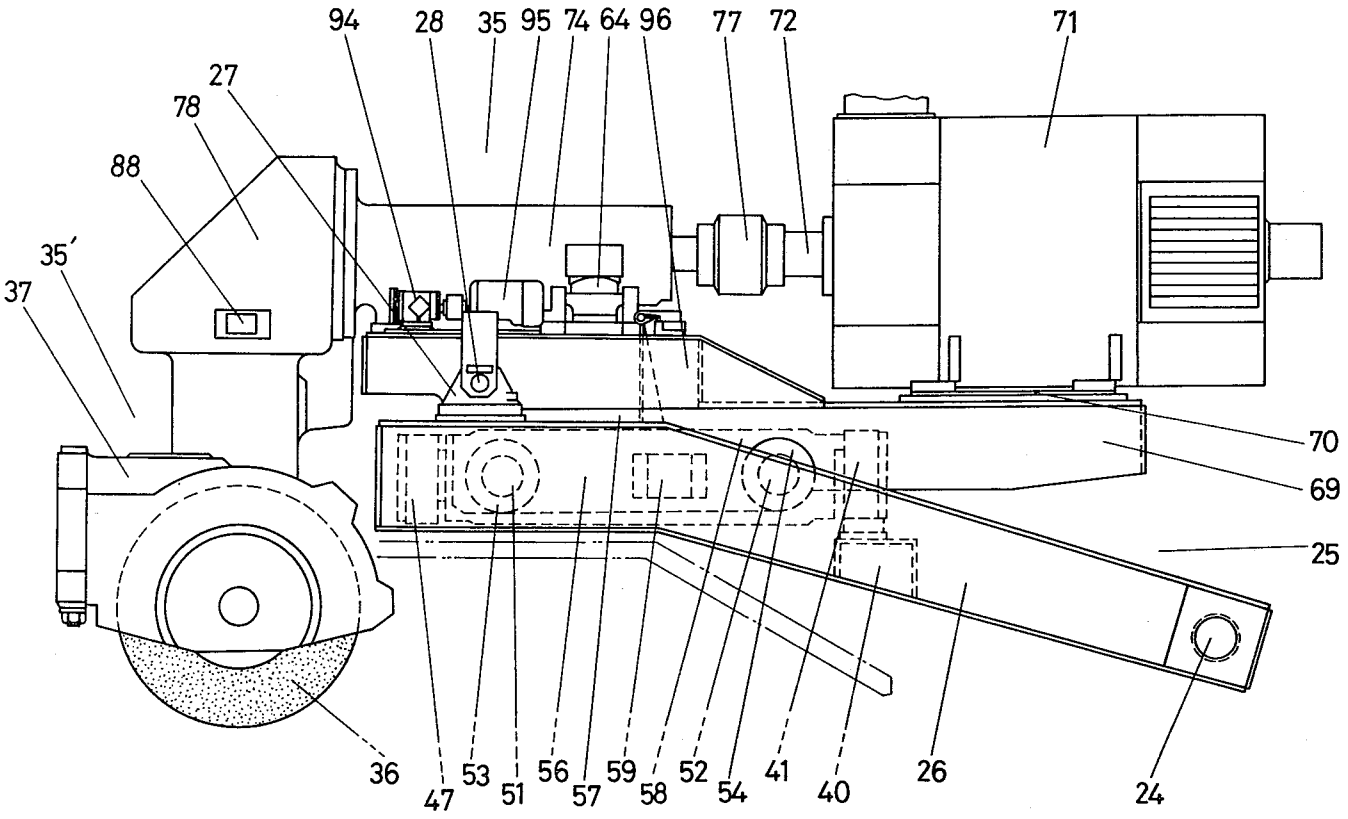
FIG. 8 is an enlarged side elevational view of parts including a tiltable frame in the grinding machine assembly.
Figure 9:
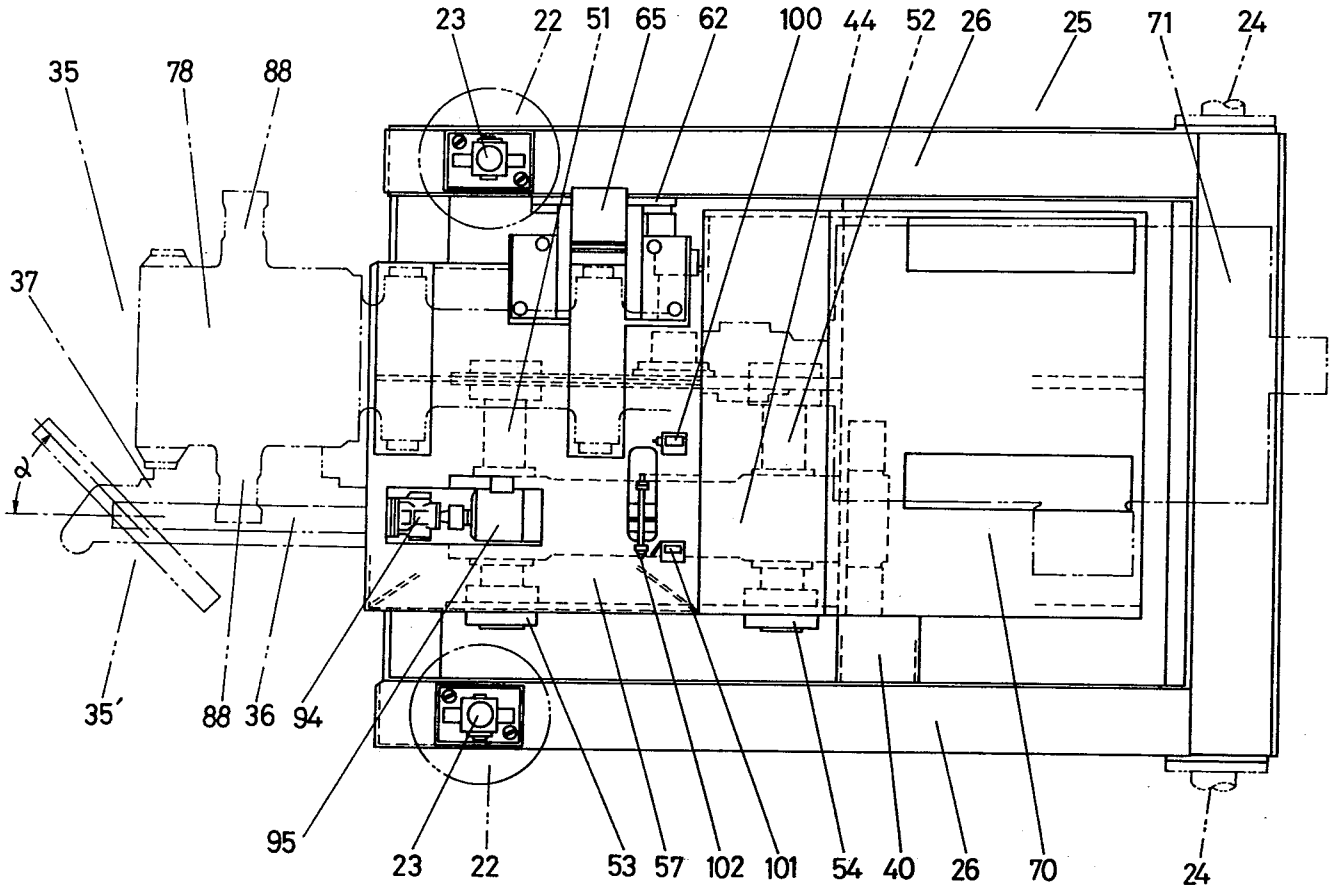
FIG. 9 is a plan view of the tiltable frame.

Upon energization of the drive motor 71, as shown in FIGS. 8 and 12, the shaft 76 housed in the horizontal casing 74 is rotated by the motor shaft 72 through the coupling 77. In response thereto, the vertical shaft 80 is rotated through the meshing bevel-gears 75, 81, and the shaft 91 and hence the grinding wheel 36 are rotated through the meshing bevel-gears 93, 92.

In FIGS. 13 and 14, the rack 84 is then moved in the direction of the arrowhead Z or Z' by the actuation of the hydraulic cylinder 86 and 86', whereupon the annular member 82 and hence the rotative sleeve 79 are angularly moved in the direction of the arrowhead Q or Q' through the segmental gear 83 and rack 84 that mesh with each other. At the same time, the slots 87, 87' are angularly moved until the slots 87, 87 or the slots 87', 87' become registered with the locking projections 90, 90, respectively, on the piston rods 89, 89 of the hydraulic cylinders 88, 88, respectively.

When the rack 84 is moved in the direction of the arrowhead Z, the annular member 82 is angularly moved in the direction of the arrowhead Q until the slots 87, 87 become registered with the locking projections 90, 90, respectively, whereupon the housing 37 (FIG. 12) extends perpendicularly to the horizontal casing 74. Accordingly, the axis of rotation of the grinding wheel 36 is aligned with the direction of travel of the workpiece W, whereupon the grinding wheel 36 is in its normal grinding position. Then, the hydraulic cylinders 88, 88 are actuated to move the locking projections 90, 90 radially inwardly into the slots 87, 87, respectively, until their complemental tapered surfaces closely contact each other. Thus, the rotative sleeve 78 is fixedly held via the annular member 82 with respect to the vertical casing 78, and hence the housing 37 is also fixedly held.

Conversely, when the rack 84 is moved in the direction of the arrowhead Z', the annular member 82 is angularly moved in the direction of the arrowhead Q' until the slots 87', 87' become registered with the locking projections 90, 90, respectively. The hydraulic cylinders 88, 88 are likewise actuated to lock the locking projections 90, 90 into the respective slots 87', 87', whereupon the rotative sleeve 79 is fixedly held in a position that is angularly spaced the angle of $\alpha$, and so is the grinding wheel 36 from the normal grinding position (see FIGS. 7 and 9).

Figure 6:
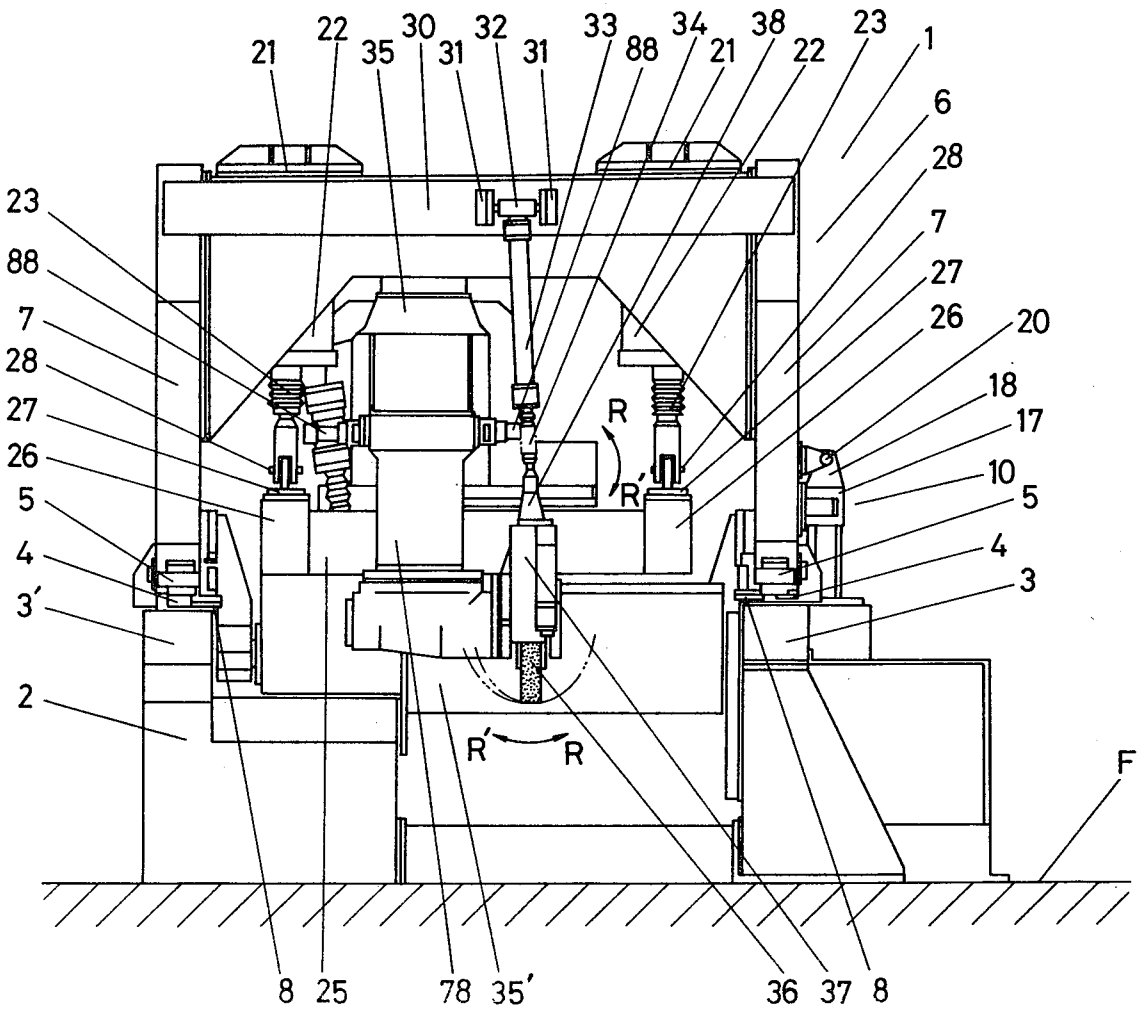
FIG. 6 is a front elevational view of the grinding machine assembly.
Figure 7:
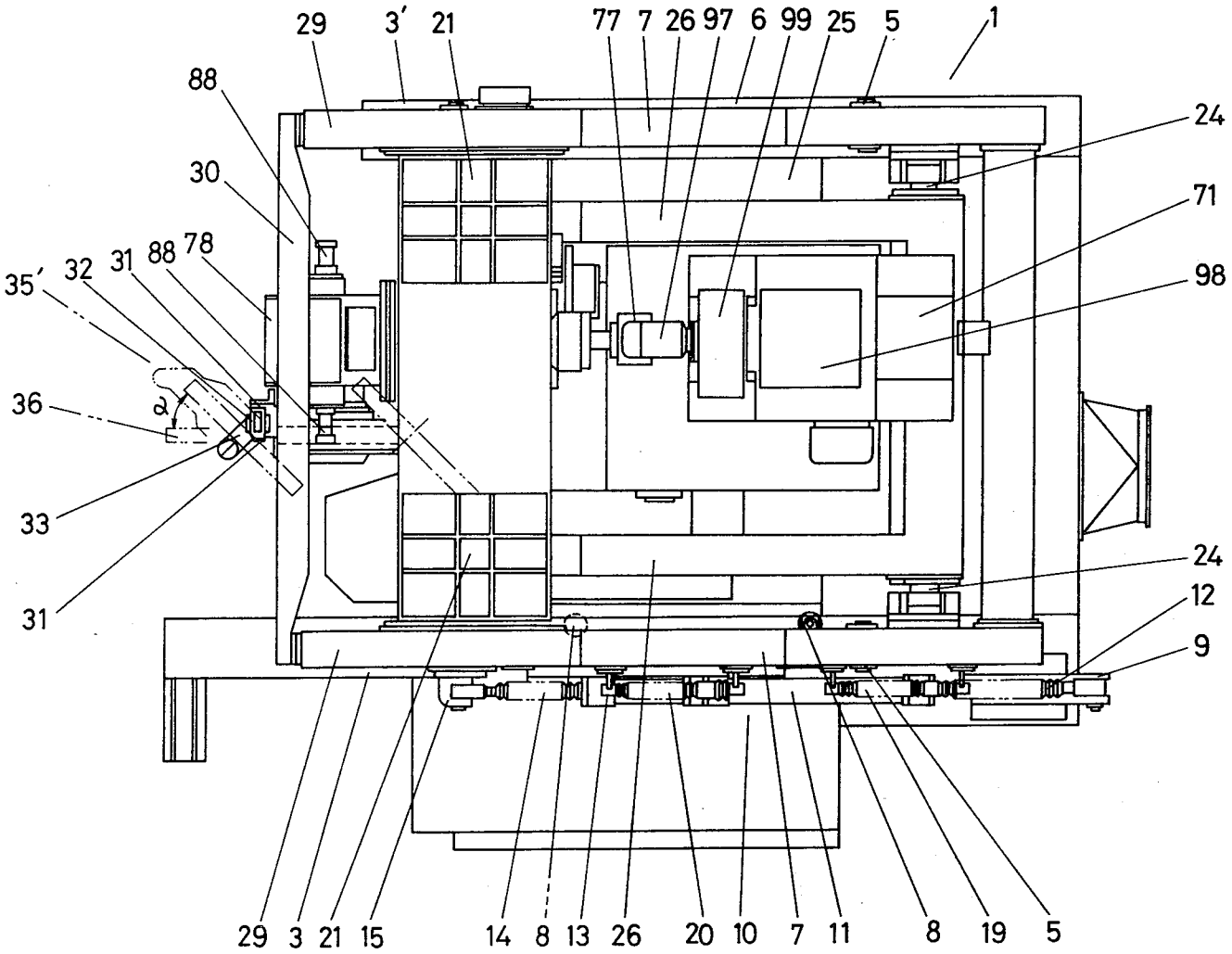
FIG. 7 is a plan view of the grinding machine assembly.

With reference to FIGS. 8, 10 and 11, when the cylinder 64 is actuated, the frame 57 is angularly moved in the direction of the arrowhead R or R' as shown in FIGS. 6 and 11, thereby causing the grinding unit 35 on the frame 57 to rock in the direction of the arrowhead R or R'.

Since the drive motor 71 which is relatively heavy is located on the board 70 on the rearward extensions 68, 69, the center of gravity of the tiltable frame 25 is displaced rearwardly so that the pneumatic cylinders 22, 22 can maintain the tiltable frame 25 in equilibrium or a state of balance with a relatively small force, with the grinding unit 35, the rocking mechanism including the cylinder 64, and the lateral positional correction mechanism including the hydraulic cylinder 61, being all mounted on the tiltable frame 25. Upon contact of the grinding wheel 36 with the surface of the workpiece W, the hydraulic cylinder 33 is actuated to apply a predetermined degree of grinding pressure. When the grinding wheel 36 is angularly moved by the angle of $\alpha$, it necessarily turns about the axis of the rotative sleeve 79 into a position which is substantially displaced two-dimensionally away from the point on the workpiece surface where grinding should be effected. To compensate for a lateral amount of displacement, the mounting frame 57 on the slide bars 55, 56 is laterally moved in the direction of the arrowhead Z or Z' by the hydraulic cylinder 61 for a distance that has initially been set by the cylinder 61. Either one of the limit switches 101, 101 (FIG. 9) on the tiltable frame 25 strikes the dog 102 on the frame 57, whereupon the hydraulic cylinder 61 is inactivated thereby completing the lateral positional correction.

Figure 4:
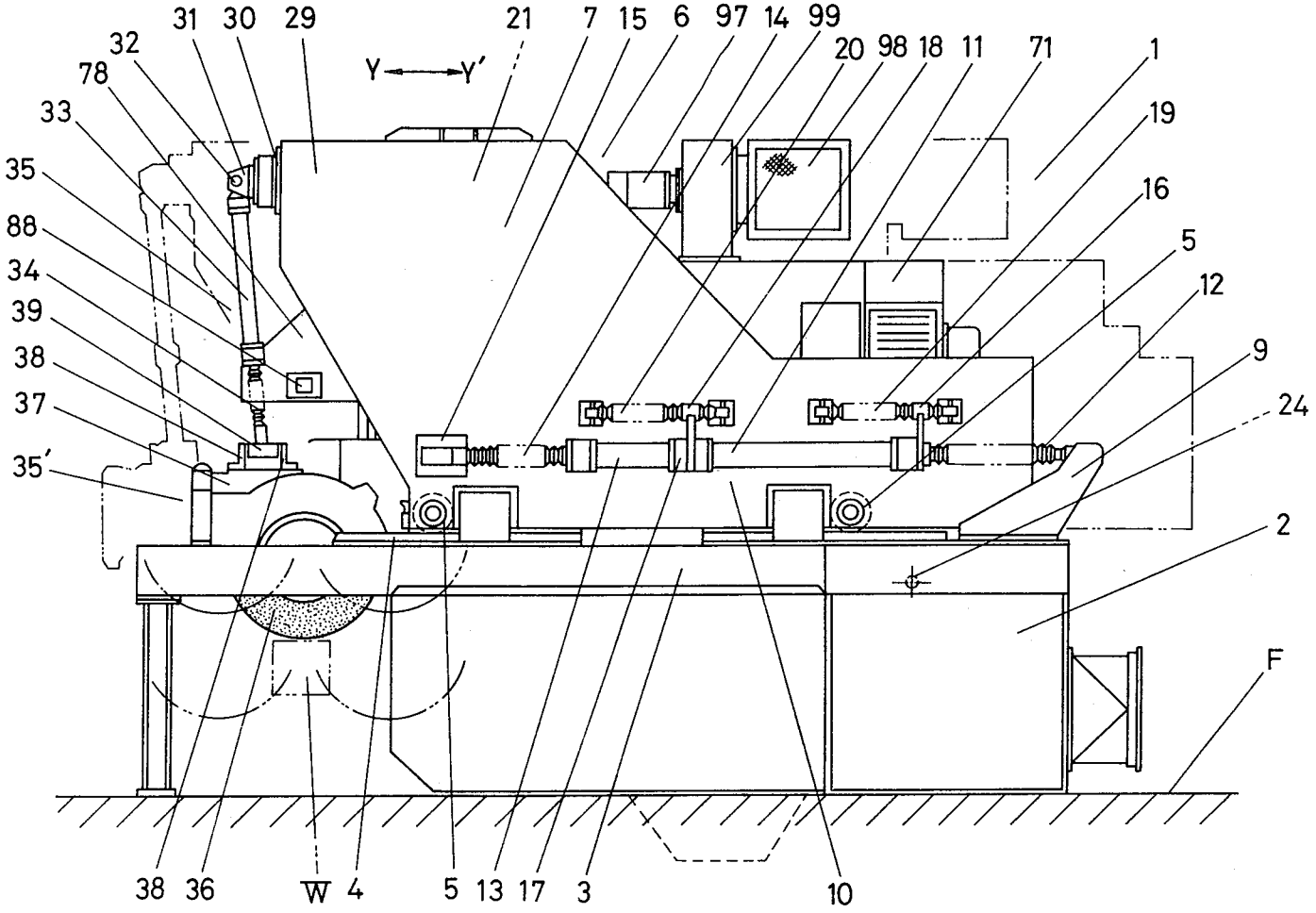
FIG. 4 is an enlarged side elevational view of a grinding machine assembly according to the invention which is incorporated in the grinding machine of FIG. 1.
Figure 5:
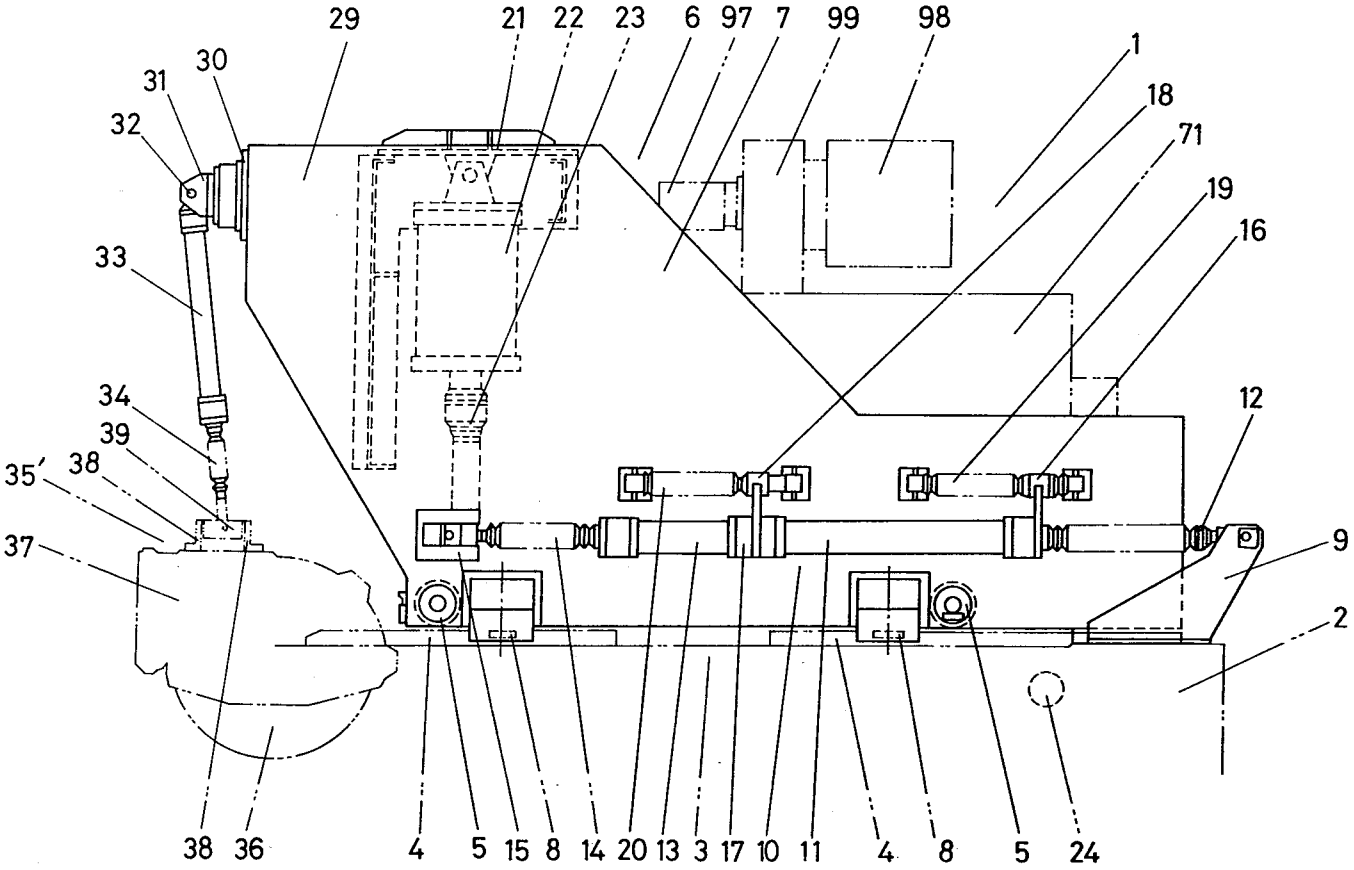
FIG. 5 is a similar side elevational view of the grinding machine assembly.

The correction cylinder 13 shown in FIGS. 4 and 5 is so designed that when the grinding wheel 36 is angularly moved and longitudinally displaced, the correction cylinder 13 will be actuated simultaneously with the normal cylinder 11 so as to cause the machine frame 6 to move in the direction of the arrowhead Y or Y' for a distance enough to compensate for the amount of displacement. In this manner, the grinding wheel 36 remains in a position most suitable for the best grinding of the workpiece surface without being displaced two-dimensionally that would otherwise occur with angular movement of the grinding wheel 36.

The hydraulic and pneumatic control circuit shown in FIG. 15 is well known as to operation, and therefore no further description thereof will be given. It can be seen from FIG. 15 that the poor followability of the balancing pneumatic cylinder 22 is compensated for by the heavy drive motor 71 located rearwardly adjacent to the fulcrum Q, maintaining the tiltable frame in substantial equilibrium, and that being disposed adjacent to the grinding wheel 36 and hydraulically powered, the cylinder 33 controls the accurate application of grinding pressure.

With the arrangement of the present invention, the motor for driving the grinding wheel is mounted rearwardly on the tiltable frame, and the driving motor and the grinding wheel are operatively coupled together by the bevel-gear mechanism, thereby maintaining the tiltable frame with the parts thereon in substantial equilibrium. Accordingly, the grinding head can be moved around with utmost ease even if it were relatively heavy for use with a relatively large grinding machine. With the structure of the invention, therefore, grinding machines of a larger size have an increased degree of grinding accuracy. Furthermore, the rotative sleeve is disposed in the vertical casing of the bevel-gear mechanism and is secured to the housing in which the grinding wheel is mounted, the rotative sleeve supporting on its upper end the annular member angularly movable by the rack mechanism and having the slots with the tapered surfaces, that are receptive of the locking projections with the complemental tapered surfaces on the piston rods of the hydraulic cylinders. The grinding wheel can thus be angularly movable between the normal and angular positions and can be selectively in such positions by the locking projections that project into the slots in the annular member, with the result that grinding of high accuracy can be achieved.

Two-dimensional displacement both in the lateral and longitudinal directions of the grinding unit relative to the workpiece surface to be ground when the grinding unit is angularly moved, can be prevented by the automatic positional correction mechanism for precision grinding.

What is claimed is:

1. A grinding machine assembly including a tiltable frame mounted in a machine frame movable back and forth on a machine base by a hydraulic cylinder assembly, a balancing pneumatic cylinder suspended from an upper portion of the machine frame and supporting the tiltable frame for tilting movement, a frame mounted on the tiltable frame for lateral slidable and angular movements, and a rocking cylinder connected between a side bar of the tiltable frame and the frame, characterized in that a lateral positional correction cylinder is connected between a rotative bar in the frame and a support plate, and that a motor for driving a grinding wheel is mounted rearwardly on the frame and is operatively coupled through a bevel-gear mechanism to a grinding head including said grinding wheel and angularly movable in the horizontal plane, there being a hydraulic cylinder pivotally connected to the machine frame at its front, upper portion and having a piston rod pivotally connected at its distal end to said grinding head.

2. A grinding machine assembly according to claim 1, said bevel-gear mechanism comprising a vertical casing, a rotative sleeve housed in the vertical casing, the grinding head being secured to a lower end of the rotative sleeve, an annular member fitted over an upper portion of the rotative member and having a segmental gear, said annular member having a plurality of pairs of slots having tapered surfaces, said slots pairs being angularly spaced a predetermined angle from each other, hydraulic cylinders mounted on said vertical casing and having piston rods with locking projections on their distal ends, said locking projections having tapered surfaces, and a rack held in mesh with said segmental gear and having its ends serving as pistons of hydraulic cylinders for actuating said rack to move back and forth.

3. A grinding machine assembly according to claim 1, said hydraulic cylinder assembly comprising a normal cylinder and a longitudinal positional correction cylinder that are joined back to back and are horizontally attached to a side plate of the machine frame, said normal cylinder having a piston rod pivotally coupled to a rear end of a beam of the machine base, said longitudinal positional correction cylinder having a piston rod pivotally coupled to said side plate, and connected to a correction mechanism for indicating an amount of longitudinal displacement to be corrected, said rotative bar being supported between a front beam and a crossbeam, said support frame being mounted on slide bars mounted on said rotative bar at its front and rear ends for slidable movement transversely of said rotative bar, said lateral positional correction cylinder having a piston rod pivotally coupled to said rotative bar, said frame being mounted on said support frame and supporting a dog, said tiltable frame supporting limit switches for detecting the completion of lateral positional correction upon being hit by said dog.

* * * * *

UNITED STATES PATENT AND TRADEMARK OFFICE

CERTIFICATE OF CORRECTION

PATENT NO. : 4,387,538

DATED : June 14, 1983

INVENTOR(S) : TETSURO OSHIMI

It is certified that error appears in the above—identified patent and that said Letters Patent is hereby corrected as shown below:

On the title page:

"[75] Inventor: Oshimi Tetsuro, Nagoya, Japan" should read

--[75] Inventor: Tetsuro Oshimi, Nagoya, Japan--

Signed and Sealed this

*Fifteenth* Day of *May 1984*

[SEAL]

*Attest:*

GERALD J. MOSSINGHOFF

*Attesting Officer*

*Commissioner of Patents and Trademarks*